United States Patent [19]

Lequeux

[11] Patent Number: 4,743,019

[45] Date of Patent: May 10, 1988

[54] APPARATUS FOR PROPRIOCEPTIVE REEDUCATION AND/OR PHYSICAL TRAINING

[76] Inventor: Bruno J. Lequeux, Rue Devant le Monty, B-4910 Libin, Belgium

[21] Appl. No.: 909,056

[22] PCT Filed: Dec. 23, 1985

[86] PCT No.: PCT/BE85/00022

§ 371 Date: Aug. 27, 1986

§ 102(e) Date: Aug. 27, 1986

[87] PCT Pub. No.: WO86/03981

PCT Pub. Date: Jul. 17, 1986

[30] Foreign Application Priority Data

Dec. 27, 1984 [BE] Belgium ..... 0/214238

[51] Int. Cl.[4] ..... A63B 21/22

[52] U.S. Cl. ..... 272/132; 272/129; 272/146; 272/DIG. 5

[58] Field of Search ..... 272/33 R, 72, 97, 129, 272/131, 132, 134, 146, DIG. 4, DIG. 5, 128, 130; 128/28 R

[56] References Cited

U.S. PATENT DOCUMENTS

| | | | |
|---|---|---|---|
| 2,530,921 | 11/1950 | Tougas | 272/132 |
| 2,573,808 | 11/1951 | Ravoire | 272/97 |
| 2,777,439 | 1/1957 | Tuttle | 272/132 X |
| 2,827,894 | 3/1958 | Meyers | 128/25 R |
| 3,021,137 | 2/1962 | Palmer et al. | 272/97 |
| 3,100,640 | 8/1963 | Weitzel | 272/132 X |
| 3,176,986 | 4/1965 | Posatsky | 272/132 |
| 3,618,595 | 11/1971 | Stahmer | 128/25 R |
| 3,869,121 | 3/1975 | Flavell | 272/129 |
| 4,386,915 | 6/1983 | Gilliam | 272/97 X |
| 4,452,447 | 6/1984 | Lepley et al. | 272/130 X |

FOREIGN PATENT DOCUMENTS

| | | | |
|---|---|---|---|
| 2420826 | 11/1975 | Fed. Rep. of Germany | 272/146 |
| 1565725 | 5/1969 | France | 272/132 |
| 2045215 | 2/1971 | France | 272/132 |
| 425573 | 5/1967 | Switzerland | 272/146 |
| 445349 | 2/1968 | Switzerland | 272/146 |
| 609869 | 3/1979 | Switzerland | 272/97 |
| 403165 | 12/1933 | United Kingdom . | |
| 961709 | 9/1982 | U.S.S.R. | 272/146 |

*Primary Examiner*—Richard J. Apley
*Assistant Examiner*—Robert W. Bahr
*Attorney, Agent, or Firm*—Fishman, Dionne & Cantor

[57] ABSTRACT

A proprioceptive rehabilitation and/or physical training apparatus is presented comprising at least one base, an inclinable turntable seated rotatably in the base and being provided with parallel grooves equidistant from one another, and an adjustable brake. The grooves have a profile of the dovetail type and are intended for receiving correspondingly profiled fastening accessories. The apparatus also possesses probes measuring the rotational speed of the turntable and positioning the latter. The brake can be controlled by a control device programmed for a particular exercise.

20 Claims, 6 Drawing Sheets

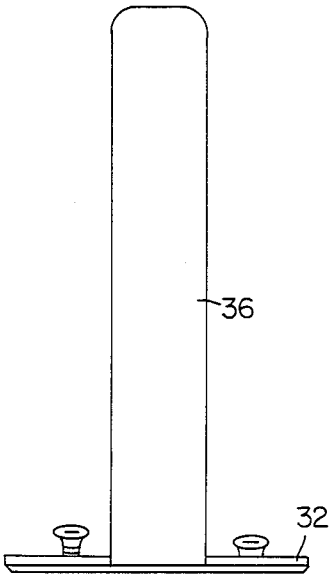
FIG.7
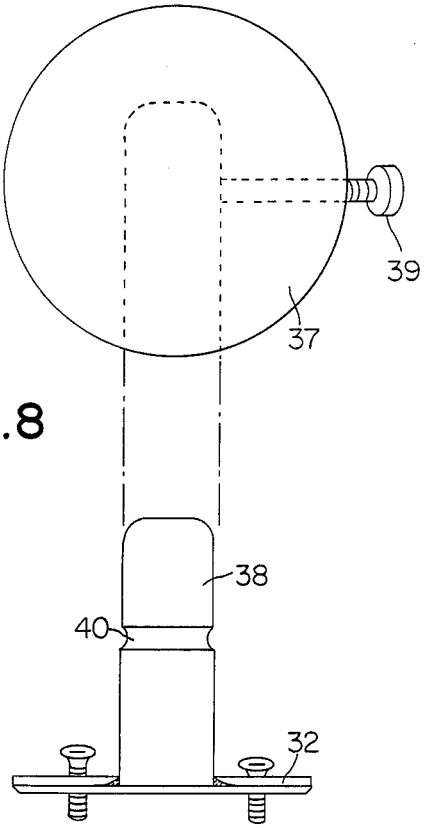
FIG.8
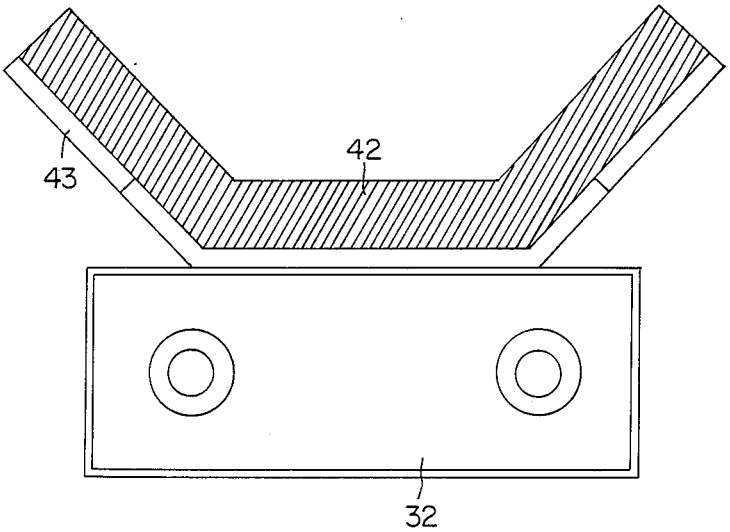
FIG.10
FIG.9
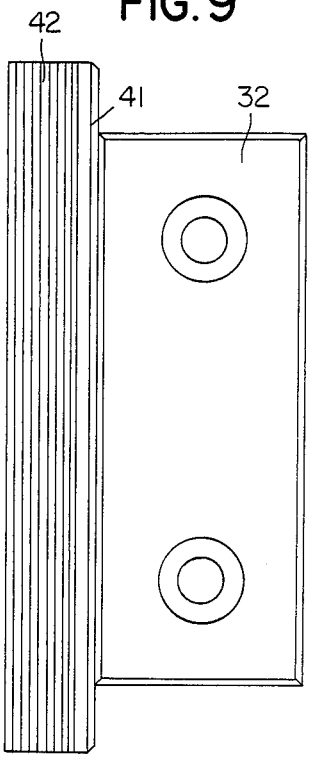

APPARATUS FOR PROPRIOCEPTIVE REEDUCATION AND/OR PHYSICAL TRAINING

SUMMARY OF THE INVENTION

The present invention relates to a multi-purpose apparatus intended for proprioceptive rehabilitation, which allows athletes to train and exercise and makes it possible to perform the sporting disciplines usually known by the English terms "body-building" and "power training".

It relates more particularly to an apparatus of the above-mentioned type, comprising at least one inclinable base, a turntable seated rotatably in the said base and provided with parallel grooves equidistant from one another, and an adjustable brake, the said grooves preferably having a profile of the dovetail type and being intended for receiving corresponding means of fastening accessories.

According to the present invention, the apparatus can be mounted on the ground or on a table horizontally or inclined relative to a horizontal plane; it can also be mounted on wall-bars or a wall of vertical structure vertically or inclined relative to a vertical plane.

The brake, adjustable according to the force which the user is to exert, can be adjusted manually, in particular by rotating a threaded rod which compresses a spring, the pressing force of which lays blocks more or less firmly against the axle of the turntable.

According to an advantageous embodiment of the invention, the brake can be of the electromagnetic type acting on a disc coaxial relative to the turntable and integral with the latter. In this case, the braking force is advantageously controlled electronically.

By the use of a series of accessories intended to be fastened rigidly to the turntable, it is possible to provide a large number of proprioceptive rehabilitation and/or physical training exercises. The following accessories may be mentioned by way of non-limiting example:

a handle which is parallel to the turntable and which, according to its location, makes it possible to execute a multiplicity of rehabilitation or muscle-building movements of the upper limbs and of the trunk;

a handle which is perpendicular to the turntable and which is equipped with a freely rotating sleeve making it possible to carry out exercises with the upper limbs;

a sphere which pivots about an axis perpendicular to the turntable or is fixed and which makes it possible to increase even further the possibilities of exercises in the region of the hand and wrist;

straps making it possible to secure certain parts of the body;

means of fastening a stool to the turntable in order to exercise the muscles of the trunk more specifically;

devices for fastening and/or supporting the heel and/or foot on the turntable, making it possible to perform ankle-flexing and -stretching exercises;

a lengthening device intended for securing the distal part of the limbs beyond the turntable, the root of these limbs being located in the region of the central axis of the said turntable; advantageously, the said lengthening device also makes it possible to fasten accessories, such as those mentioned;

at least one pedal axle carrying a plate which is itself mounted on a ball or on an axle and which can receive an item of equipment or a pedal-bearing assembly;

two studs, each welded to a base plate, making it possible to fit a Freeman board.

Combinations of the abovementioned accessories are also possible, and the accessories can be fastened by screwing, clamping, clipping or any other equivalent means.

The adjustable brake can progressively increase the resistance to the rotation of the turntable, to make it necessary for the user to exert greater strength to execute the various movements, or can block the rotational movement of the turntable in certain limiting angular positions.

It is clear that other braking devices can be provided, these acting if appropriate, on linear movements of accessories in the grooves of the turntable.

According to an especially preferred embodiment of the present invention, the turntable, as described above, is controlled, for example, by a programmable control device, for example, of the microprocessor type, or any other equivalent means, which can control the action of the brake according to a predetermined and, if appropriate, repetitive cycle. In this case, the turntable is also equipped with sensors which make it possible to detect the angular position of the turntable, the rotational speed of the latter and, if appropriate, the number of movements executed.

A display and/or recording of the exercises carried out is possible according to the invention, and it is likewise possible, at the start of the exercise, to display the type of movements to be executed and their number for a particular patient and for the specific preparation of an athelete or sportsman.

BRIEF DESCRIPTION OF THE DRAWINGS

The invention will be described in more detail below by means of the drawings in which;

FIGS. 7, 8, 9, 10 and 11 show other accessories which can be fitted to the apparatus according to the invention;

DETAILED DESCRIPTION OF THE PREFERRED EMBODIMENT

Figure 1:
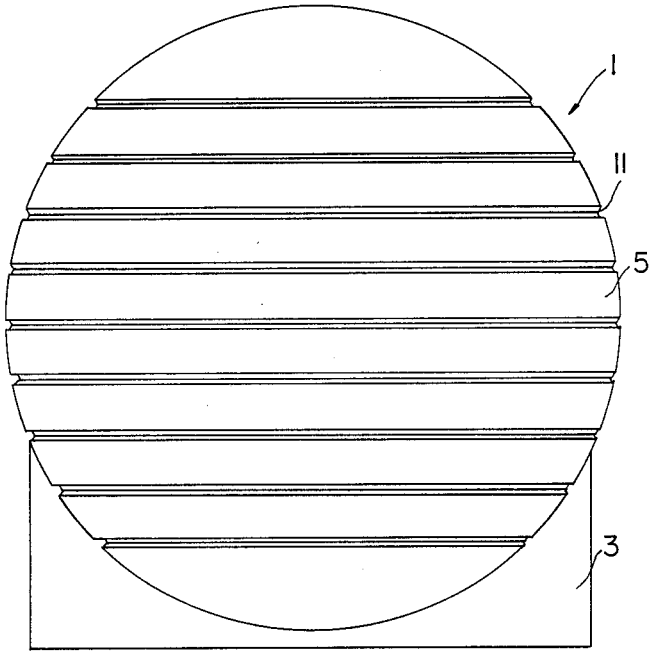
FIGS. 1 and 2 show the apparatus according to the invention in a plan view and a side view, respectively.

In the Figures, identical reference numerals represent identical or similar elements.

Figure 2:
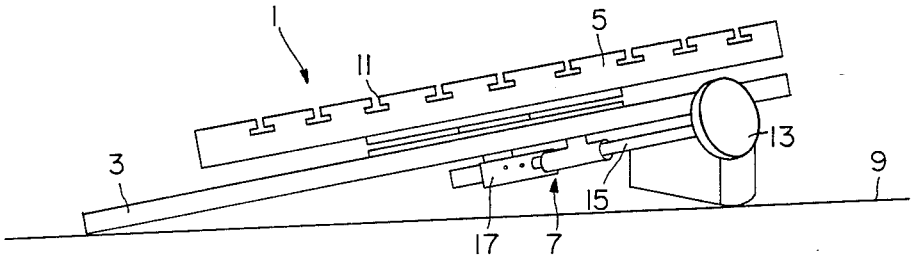

With reference to FIGS. 1 and 2, the proprioceptive rehabilitation and/or physical training apparatus 1 comprises a base 3, a turntable 5 and a brake 7. In the embodiment illustrated in FIG. 2, the base 3 is inclined relative to the horizontal plane 9. The turntable 5 is provided with parallel grooves 11 having a profile in the form of an upturned T. According to FIG. 2, the brake 7 can be actuated manually by means of the handwheel 13 integral with the threaded rod 15 which compresses a spring, the force of which lays blocks 17 against the axle of the turntable.

Figure 3:
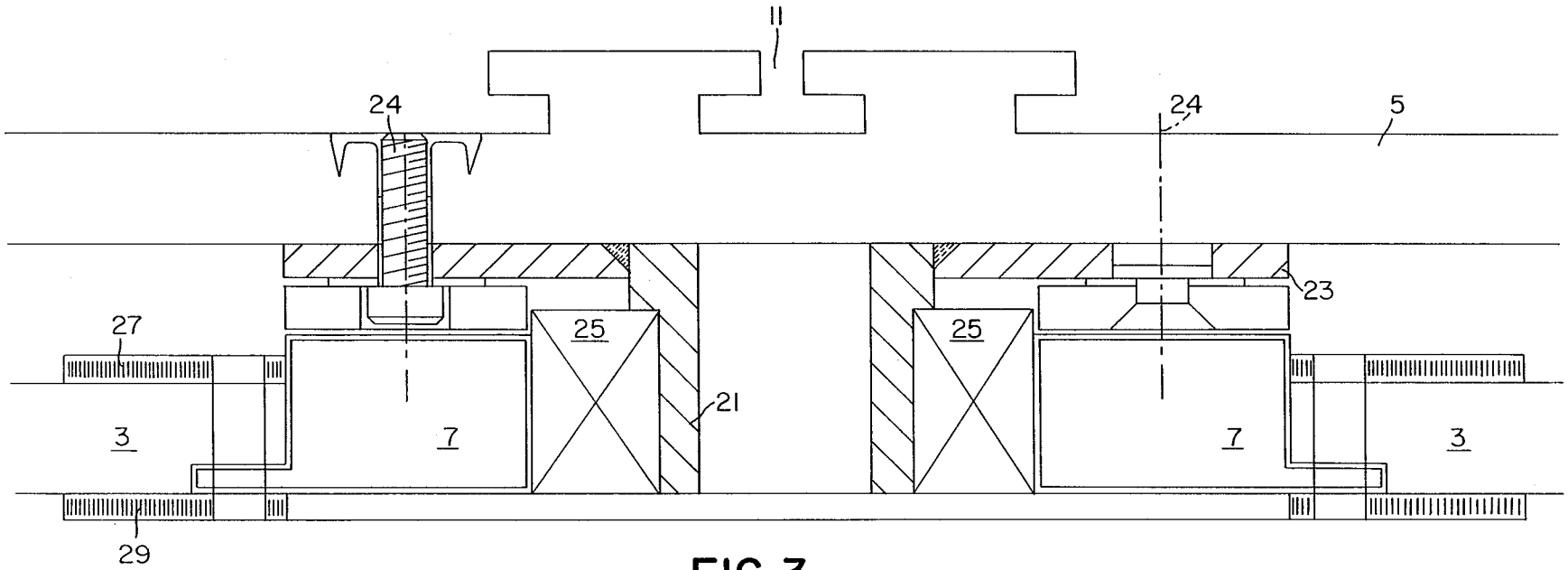
FIG. 3 is a partial diagrammatic sectional view of the apparatus acording to the invention, equipped with an electromagnetic brake.

FIG. 3 relates to another embodiment of the apparatus according to the invention, which makes use of an electromagnetic brake 7 known per se. The turntable 5 provided with its grooves 11 is fixed to its rotary shaft 21 by means of a flange 23 and screws 24. The said shaft 21 is seated rotatably in the base 3 by means of suitable conventional bearings 25. The electromagnetic brake integral with the base acts on the flange 23 in order to brake or even block the rotation of the latter and consequently that of the turntable 5. In a conventional way, the electromagnetic brake 7 is concentric relative to the axis of rotation of the turntable 5 and is incorporated in the base, being fastened to the latter by means of two rings 27 and 29 joined together on either side of the latter.

Figure 4:
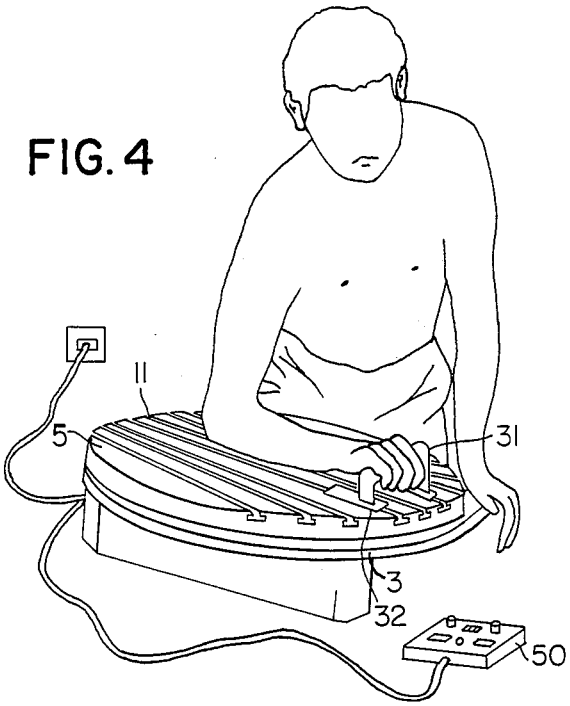
FIGS. 4, 5 and 6 illustrate the use of some accessories fitted on the apparatus according to the invention.
Figure 5:
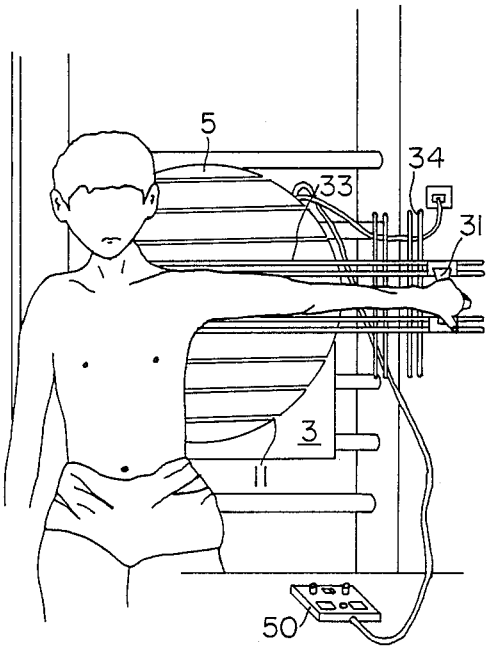
Figure 6:
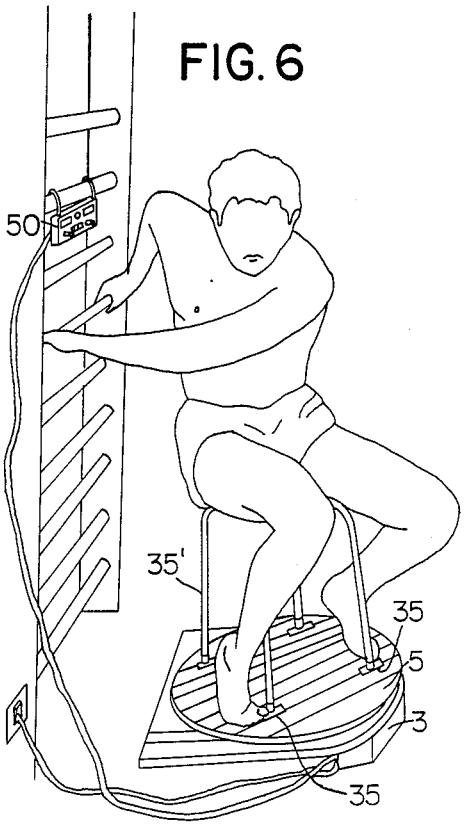

FIGS. 4, 5 and 6 illustrate several uses of the apparatus according to the invention for special exercises and movements, together with the use of some accessories. In the embodiments illustrated, the base 3 projects substantially beyond the turntable, to provide a good support for the latter. Moreover, the apparatus according to the invention is controlled by an electronic control 50 which will be described in more detail later.

In FIG. 4, the accessory used consists of a handle 31 fastened to the periphery of the turntable by means of two inserts 32 of a standard type which are secured in the grooves 11.

In FIG. 5, the turntable is equipped with a lengthening piece 33 consisting of two parallel rails which, if appropriate, have a slot similar to the grooves 11 and which can be equipped with other accessories, such as, for example, the handle 31. Moreover, the end of this lengthening piece 33 can have two perpendicular rails 34 of the same type.

FIG. 6 shows accessories 35 making it possible to fasten a stool 35' to the turntable 5. Such an accessory consists, for example, of a socket which has a clamping screw.

FIG. 7 illustrates a vertical handle 36 which can be mounted on the turntable 5 by means of the same standard insert 32 integral with the said handle. The latter can also be surrounded by a suitable socket, in order to make it easier to execute certain special movements.

FIG. 8 shows an accessory similar to the preceding one, equipped with a sphere 37 to allow certain movements of the wrist. The said sphere 37 can be fixed to its axle 38 by means of a clamping screw 39 which can engage in a slot 40.

FIG. 9 illustrates a support 41 covered with protective material 42 and fitted on the turntable by means of the plate of standard size 32. The said support can be equipped with a strap which makes it possible to attach a limb.

The accessory 43 illustrated in FIG. 10 is similar to the preceding one, but is better suited to the heel because of its trapezoidal shape.

Figure 11:
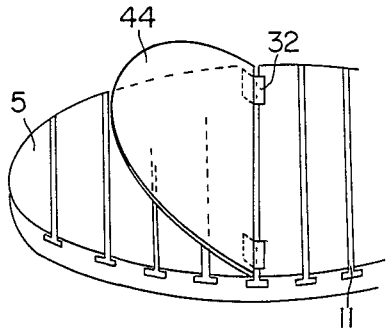
Figure 12:
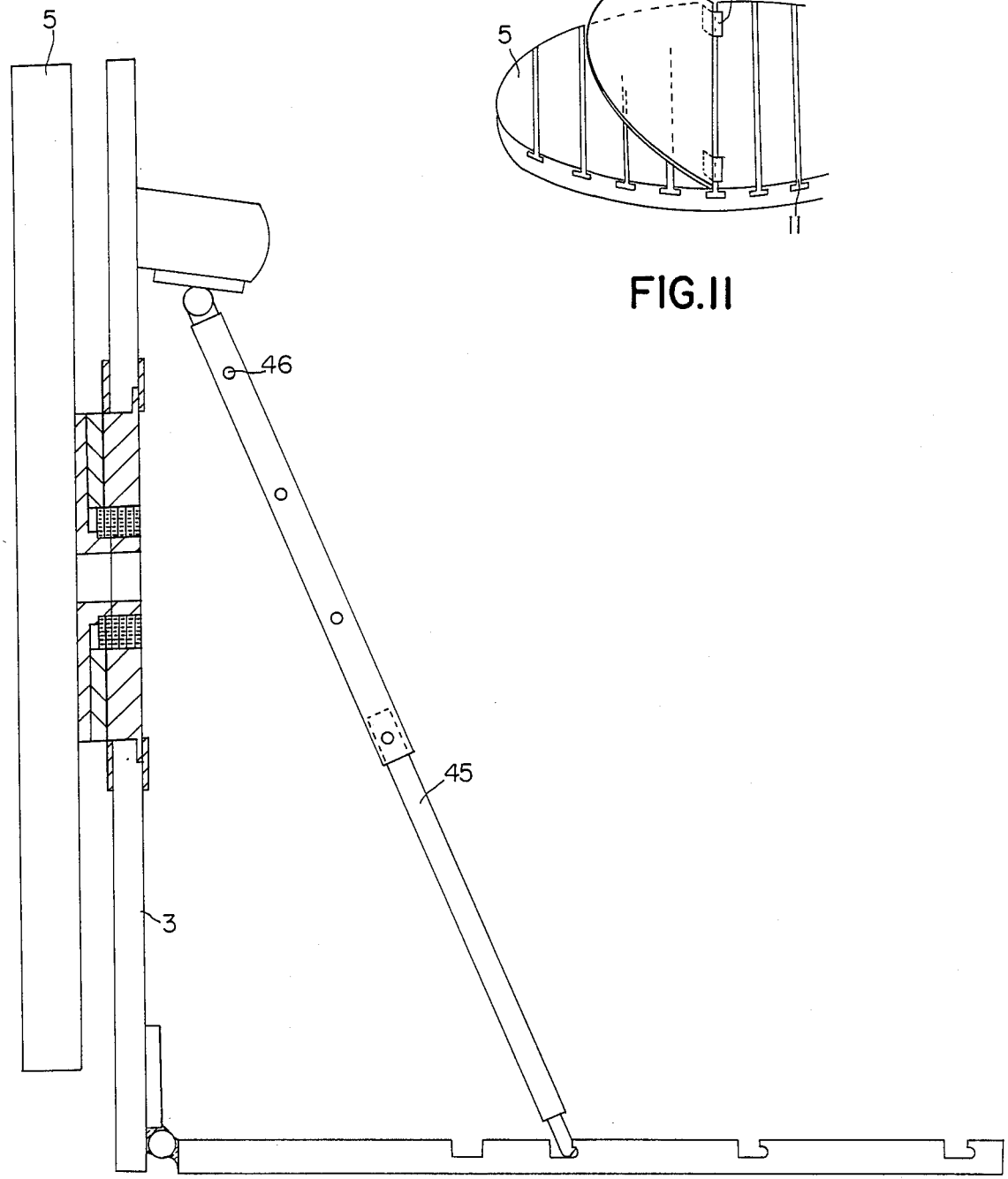
FIG. 12 shows the mechanism for inclining the turntable.

A final accessory described in the non-limiting list mentioned is shown diagrammatically in FIG. 11. It consists of a semicircular plate 44 which is articulated on inserts of standard size 31 and which can be positioned at a particular angle relative to the turntable 5.

The said plate 44 can also be provided with grooves similar to the grooves 11 in the turntable 5.

Figure 13:
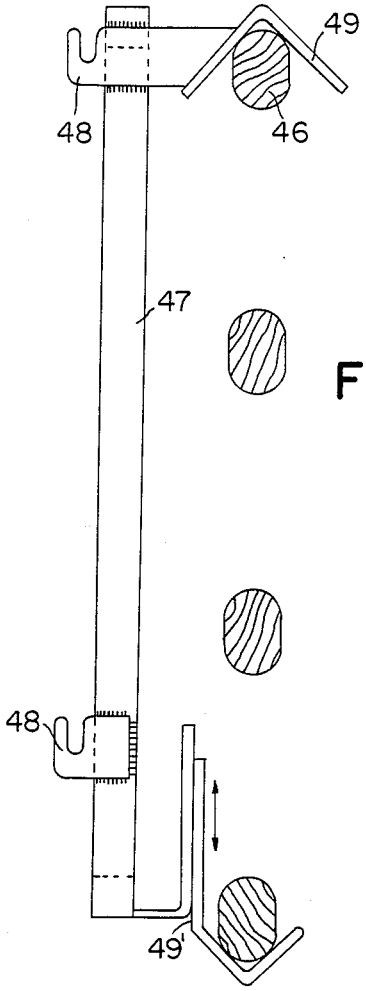
FIG. 13 shows a device for suspending the apparatus according to the invention on wall-bars.

As already mentioned, the base 3 can be positioned at various inclinations. According to one embodiment, the base 3 is articulated on a rest 45 and can be held in position relative to the latter by means of a system of telescopic links or rods 45' having stop pins 45'' for some specific positions. Alternatively, the apparatus 1 can be suspended on wall-bars 46 (FIG. 13) by means of a suitable suspension frame 47 which has, in addition to an upper attachment device 49, an adjustable lower attachment device 49'. This suspension frame is equipped with at least two pairs of hooks 48, in which is anchored the rest equipped with studs for attaching the apparatus 1. The height of the assembly as a whole can be adjusted as required.

Figure 14:
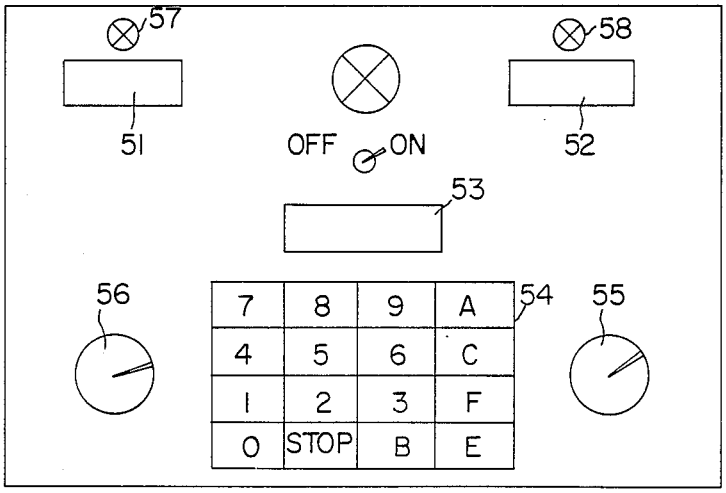
FIG. 14 gives an example of a display board combined with a microprocessor which is associated with the apparatus according to the invention.

It is especially preferred to associate a control device which is programmable or has a microprocessor with the apparatus according to the invention. Such a device can be controlled and programmed by means of a display board 50, as illustrated in FIG. 14.

In this case, a considerable number of functions, as described below, can be provided.

The display board 50 advantageously comprises three indicators known per se, each comprising three units. The indicators 51 and 52 indicate, in each direction, the number of revolutions or fractions of a revolution which still remain to be executed. The indicator 53 makes it possible to enter data, display the amount of movement to be executed in each direction, and display the number of revolutions still remaining to be executed, where complete revolutions in one direction are concerned, and the rotational speed. A 16-key keyboard 54 makes it possible, for example, for a kinesitherapist to enter data. The potentiometers 55 and 56 make it possible to adjust the braking torque in each direction. Other conventional means, such as sound or light signals 57 and 58, can also be provided in order to signal the end of the exercise.

It is likewise possible to vary the braking torque during one and the same cycle or during the complete exercise by means of suitable programming.

In an embodiment such as that described, the turntable must, of course, be equipped with various probes, such as probes for measuring the rotational speed, positioning probes, etc.

It is therefore possible, starting from a specific zero point, to programme, for example, a number of angular movements (amount, speed, number) with a braking force which is constant or variable during the movement.

The data produced by the probes can also be recorded and stored in a computer which enables the kinesitherapist to follow the patient's progress.

The apparatus according to the invention makes it possible to perform a large number of different exercises and is relatively compact. In particular, it can be used by a kinesitherapist at a patient's bedside or home. It can be adapted to the physical condition of the user and allows the latter to improve this physical condition quickly by means of progressive exercises which can easily be programmed.

I claim:

1. Proprioceptive rehabilitation and/or physical training apparatus comprising:

at least one base;

means attached to said base for inclining said base with respect to a support surface;

a turntable rotatably attached to said base and inclinable with said base, said turntable having a plurality of spaced parallel grooves therein, each of said grooves having a pre-selected cross section and means for receiving and retaining fastening accessories having cross sections matching said pre-selected cross section of said grooves; and adjustable brake means associated with said rotary turntable.

2. Apparatus according to claim 1 wherein:

said grooves are equidistantly spaced from one another.

3. Apparatus according to claim 1 wherein:

said pre-selected cross section has an inverted T shape.

4. Apparatus according to claim 2 wherein:

said pre-selected cross section has an inverted T shape.

5. Apparatus according to claim 1 including:

mean for mounting said base in a horizontal, vertical or intermediate angular position.

6. Apparatus according to claim 5 wherein said means for mounting said base comprises:

first support means pivotably articulated to second support means, said base being attachable to said first support means;

telescoping linking means or adjusting the angular position between said first and second support means; and mean for locking said telescoping linking means at a desired length.

7. Apparatus according to claim 5 wherein said means for mounting said base is adapted for mounting on horizontal wall bars and comprises:

suspension frame means having upper bar attachment means and lower bar attachment means, at least one of said upper and lower bar attachment means being adjustable, said suspension frame means further including means for attachment to said base means.

8. Apparatus according to claim 1 wherein said turntable is rotatably mounted on an axis and wherein:

said brake means is adjusted manually by rotation of a threaded rod which compresses a spring, the compression force of said spring urging block means against said axle of said turntable.

9. Apparatus according to claim 1 wherein said brake means comprises:

a manually adjustable electromagnetic brake.

10. Apparatus according to claim 1 wherein said brake means comprises:

an electronically adjustable electromagnetic brake.

11. Apparatus according to claim 1 including:

an accessory comprised of a lengthening piece, said lengthening piece including two parallel rails having a slot for fastening other accessories, said slot having a cross section substantially similar to said pre-selected cross section of said grooves.

12. Apparatus according to claim 1 including:

pedal assembly means mounted on a ball for receiving an item of equipment.

13. Apparatus according to claim 1 including:

pedal assembly means mounted on an axle for receiving an item of equipment.

14. Apparatus according to claim 1 including:

a programmable control devie, the program of which is adapted to the desired movements of said turntable.

15. Apparatus according to claim 1 wherein said turntable includes:

positioning measuring probes.

16. Apparatus according to claim 1 wherein said turntable includes:

rotational speed measuring probes.

17. Apparatus according to of claim 15 wherein said turntable includes:

rotational speed measuring probes.

18. Apparatus according to claim 14 wherein:

the type of erercises to be carried out and their number are displayed at the start of each series of exercises.

19. Apparatus according to claim 1 including:

sound signaling means.

20. Apparatus according to claim 1 including:

light signaling means.

* * * * *